United States Patent [19]

Gorondy

[11] 4,453,492

[45] Jun. 12, 1984

[54] MAGNETIC DEVELOPING UNIT WITH IMPROVED TONER DECORATOR FOR MAGNETIC PRINTING

[75] Inventor: Emery J. Gorondy, Chadds Ford, Pa.

[73] Assignee: E. I. Du Pont de Nemours and Company, Wilmington, Del.

[21] Appl. No.: 407,643

[22] Filed: Aug. 12, 1982

[51] Int. Cl.[3] ..... B05C 5/02

[52] U.S. Cl. ..... 118/623; 118/636

[58] Field of Search ..... 118/655, 658, 623, 636, 118/652; 355/3 DD, 15; 430/39

[56] References Cited

U.S. PATENT DOCUMENTS

| | | | |
|---|---|---|---|
| 3,455,276 | 7/1969 | Anderson | 118/637 |
| 3,601,091 | 8/1971 | Preckshot | 430/39 X |
| 3,828,730 | 8/1974 | Yamashita et al. | 118/637 |
| 3,921,577 | 11/1975 | Howard et al. | 118/658 |
| 3,977,361 | 8/1976 | Nagashima et al. | 118/658 X |
| 4,267,201 | 5/1981 | Nakahara et al. | 427/27 |

*Primary Examiner*—Evan K. Lawrence

[57] ABSTRACT

Disclosed is a magnetic developing unit having a decorator for applying magnetic toner to a latent magnetic image in a downwardly moving magnetic imaging member. Preferably the imaging member is in the surface of a cylinder and the decorator is at the 3 o'clock or 9 o'clock position. The decorator comprises a housing containing a lower toner supply and background cleaner roll, an intermediate toner transfer roll and an upper toner decorator roll. Each of the rolls comprises a rotating non-magnetic sleeve and a plurality of elongated internal magnets which alternate in polarity adjacent the rotating sleeve and their relative positions are adjustable.

5 Claims, 3 Drawing Figures

MAGNETIC DEVELOPING UNIT WITH IMPROVED TONER DECORATOR FOR MAGNETIC PRINTING

FIELD OF THE INVENTION

The present invention relates to a magnetic developing unit comprising a decorator for applying magnetic toner to a magnetic imaging member. The developing unit is used in a magnetic printing and dyeing process using the decorator.

U.S. Pat. No. 3,455,276 discloses a decorator for applying magnetic toner to an imaging member wherein an elongated stationary cylinder formed of a plurality of elongated magnets which magnets alternate in polarity and have their north-south poles situated radially from each other along the length of the cylinder. The magnetic cylinder is mounted within a closely spaced non-magnetic rotating sleeve. The sleeve is partially immersed in toner in a hopper like tray. The toner moves with the surface of the rotating sleeve and brushes against the surface of an electrostatic imaging member where part of the toner is transferred to the electrostatic imaging member.

U.S. Pat. No. 3,828,730 discloses a magnetic decorator for applying toner to a latent electrostatic image in an imaging member which utilizes a rotating non-magnetic sleeve fitted over a stationary cylindrical magnet which has an odd number of magnetic poles running the length of the cylindrical magnet in its surface. After being applied to the rotating sleeve the toner moves with the rotating sleeve until the electrostatic toner is transferred to a latent electrostatic image.

U.S. Pat. No. 4,267,201 discloses magnetic brush developers or decorators in which a plurality of rotating non-magnetic sleeves, each containing two linear magnets are used to apply toner to a latent electrostatic image in an electrostatic imaging member.

SUMMARY OF THE INVENTION

The present invention relates to a magnetic developing unit comprising a magnetic decorator for applying magnetic toner to a magnetic imaging member. The decorator uses three or more rotating cylinders each fitted with a plurity of elongated internal bar magnets to feed toner from a sump to the decorator roll.

DETAILED DESCRIPTION OF THE DRAWINGS

Figure 1:
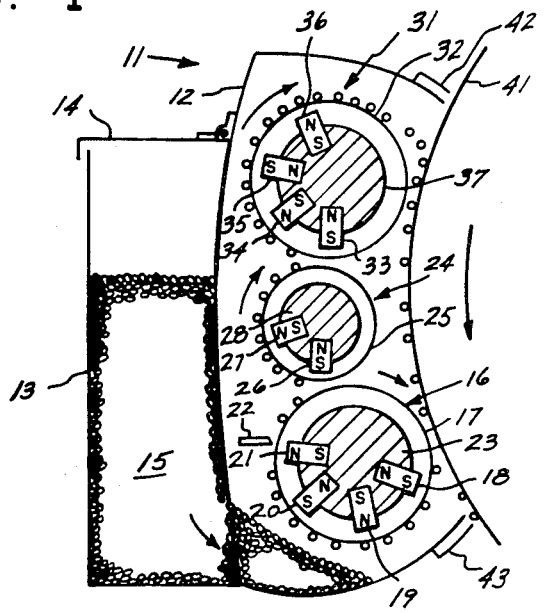
FIG. 1 is a schematic sectional view of the magnetic developing unit of the present invention.

Referring now to FIG. 1, a decorator depicted generally at 11 is shown. The decorator 11 has a housing 12 and a toner supply box 13 fitted with hinged lid 14. Toner 15 flows by gravity from supply box 13 through a slot in housing 12 to the bottom of decorator 11 where it is attracted to toner supply and background cleaner roll 16 comprising rotating cylindrical sleeve 17, by means of permanent magnets 18, 19, 20 and 21 mounted in a stationary core 23. Doctor knife 22 serves to control the amount of toner picked up by toner supply and background cleaner roll 16. Cylindrical sleeve 16, doctor blade 22 and stationary core 23 are formed of non-magnetic material. The toner is then transferred to toner transfer roll 24, comprising rotating non-magnetic cylindrical sleeve 25, permanent magnets 26 and 27 and non-magnetic stationary core 28. From transfer roll 24 the toner is transferred to decorator roll 31 comprising rotating non-magnetic cylindrical sleeve 32, permanent magnets 33, 34, 35 and 36 and non-magnetic stationary core 37. The toner is cascaded from decorator roll 31 to a magnetic imaging member 41. As the toner 15 travels downwardly on magnetic imaging member 41, it passes close enough to toner supply and background cleaner roll 16 that toner which is on non-magnetized areas of magnetic imaging member 41 is removed. Cores 23, 28 and 37 of rolls 16, 24 and 31 are adjustable so that the amount of toner 15 applied to the latent magnetic image in magnetic imaging member 41 and removed from background areas of magnetic imaging member can be adjusted, i.e., optimized for various speeds of magnetic imaging member. Decorator 11 is equipped with vacuum knives 42 and 43 to keep toner 15 from escaping from the system.

Figure 2:
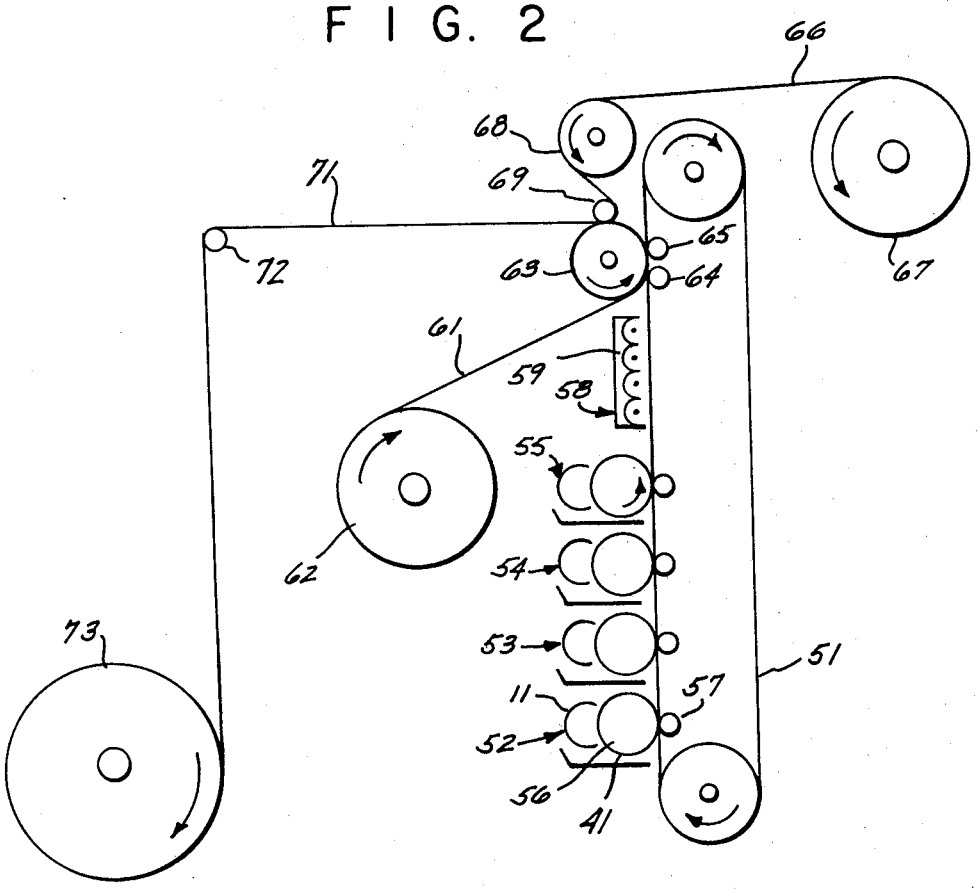
FIG. 2 is a schematic view of the vertical printing apparatus used in conjunction with the present invention.

Referring now to FIG. 2, an endless belt 51, formed of a thermally stable non-dyeable material is transported past a series of magnetic printers 52, 53, 54, and 55 for printing different color images on the endless belt 51. Each of the magnetic printers comprises the decorator 11, described above, a grounded electrically conductive magnetic imaging member 41 mounted on a roll 56 and a DC corona or a DC biased transfer roll 57 which causes the toner to transfer to endless belt 51 as described in U.S. Pat. No. 4,117,498 the disclosure of which is hereby incorporated by reference. After having an image printed at each of the printing stations endless belt 51 passes by heater 58 containing a plurality of infrared lamps 59 to preheat the toner 15. A film of thermally stable, sublimable-dye-permeable polymeric film 61 formed of a material such as a poly(ethylene terephthalate) is removed from roll 62 and fed along with endless belt 51 between heated offset roll 63 and nip rolls 64 and 65 to transfer the toner to film 61. A second thermally stable, sublimable-dye-permeable polymeric film 66 is removed from roll 67 and fed over roll 68 to nip roll 69. Film 61 decorated with the fused toner image is passed along with film 66 between nip roll 69 and heated offset roll 63 to form a laminate 71 with the fused toner image sandwiched between films 61 and 66. The laminate 71 is passed over idler roll 72 and taken up on roll 73.

Figure 3:
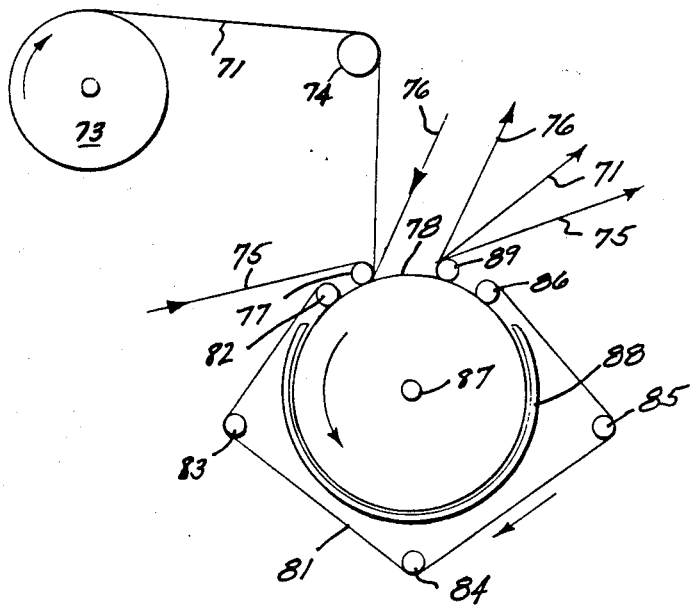
FIG. 3 is a schematic view of the apparatus used to transfer dye through a film to a textile material.

Referring now to FIG. 3, laminate 71 is removed from roll 73 and fed along with textile materials 75 and 76 between roller 77 and heated rotating cylinder 78. Laminate 71 is held in intimate contact with textile materials 75 and 76 and textile material is held in intimate contact with heated rotating cylinder 78 by means of endless pressure belt 81. Endless pressure belt 81 is urged towards heated rotating cylinder 78 by means of rollers 82, 83, 84, 85 and 86. Rotating cylinder 78 is internally heated with recirculating oil and an external heater 88. As laminate 71 and textile fabrics 75 and 76 pass around heated rotating cylinder 78 the sublimable dye in toner 15 sublimes through films 61 and 66 which are part of laminate 71 and dye textile materials 75 and 76. Finally laminate 71 and textile materials are fed around roller 89 and separately taken up by means, not shown. By extending the dwell time (reducing the speed) on cylinder 78, additional passes of laminated film 71 and textile materials can be achieved. This results in additional rolls of textile films being dyed from the same laminated film 71.

I claim:

1. A magnetic developing unit comprising a decorator for applying magnetic toner to a magnetic imaging member adapted to move in a generally downwardly direction comprising a housing, a hopper adapted to feed toner to the lower portion of said housing, a toner supply roll disposed within said housing horizontally and parallel to said imaging member in the lower portion of said housing adapted to attract toner from the lower portion of said housing, said toner supply roll comprising a non-magnetic, rotatable cylindrical sleeve containing a plurality of stationary elongated bar magnets which alternate in polarity adjacent to the rotating cylindrical sleeve, a toner transfer roll disposed horizontally, parallel to said imaging member, and generally above said toner supply roll, adapted to receive toner from said toner supply roll, comprising a non-magnetic, rotatable cylindrical sleeve containing a plurality of stationary elongated bar magnets which alternate in polarity adjacent to the rotating cylinder, a decorator roll disposed horizontally, parallel to said imaging member, and generally above said toner transfer roll, adapted to receive toner from said toner transfer roll and apply toner to said imaging member comprising a non-magnetic, rotatable cylindrical sleeve containing a plurality of stationary bar magnets which alternate in polarity adjacent to the rotating cylinder, a grounded electrically conductive magnetic imaging member for receiving the magnetic toner and means for moving said imaging member to allow a portion of the imaging member to pass adjacent the decorator roll prior to the toner supply roll during transfer of magnetic toner.

2. The magnetic developing unit of claim 1 wherein the toner supply roll is situated with respect to the imaging member so that it will remove toner from non-magnetized areas of the imaging member.

3. The magnetic developing unit of claim 2 wherein the imaging member is in the surface of a cylinder.

4. The magnetic developing unit of claim 3 wherein the toner supply roll is fitted with a doctor blade to control the amount of toner attracted thereto.

5. The magnetic developing unit of claim 4 wherein the position of all internal magnets are adjustable.

* * * * *